United States Patent [19]

Takano

[11] Patent Number: 4,625,816

[45] Date of Patent: Dec. 2, 1986

[54] BORING DRILL BIT

[75] Inventor: Sho Takano, Norita, Japan

[73] Assignee: Sumitomo Metal Mining Company Limited, Tokyo, Japan

[21] Appl. No.: 728,298

[22] Filed: Apr. 29, 1985

[51] Int. Cl.[4] ..... E21B 10/22

[52] U.S. Cl. ..... 175/371; 384/96

[58] Field of Search ..... 175/370–372, 175/364, 359, 367, 337, 339; 384/92–96

[56] References Cited

U.S. PATENT DOCUMENTS

| | | | |
|---|---|---|---|
| 2,104,819 | 1/1938 | Schlumpf et al. | 384/92 |
| 3,761,145 | 9/1973 | Schumacher, Jr. | 175/371 X |
| 4,098,358 | 7/1978 | Klima | 175/371 X |
| 4,156,470 | 5/1979 | Bodine et al. | 175/372 X |
| 4,157,122 | 6/1979 | Morris | 175/371 X |
| 4,181,377 | 1/1980 | Oelke | 384/96 |
| 4,266,622 | 5/1981 | Vezirian | 175/371 X |
| 4,533,003 | 8/1985 | Bailey et al. | 175/371 X |

*Primary Examiner*—Stephen J. Novosad
*Assistant Examiner*—David J. Bagnell
*Attorney, Agent, or Firm*—Watson, Cole, Grindle & Watson

[57] ABSTRACT

A boring drill bit comprises a shank having one end attached to a drill pipe; a plurality of inclined pins extending from the other end of the shank radially and at an inclination toward the ground with respect to the center line of the shank; a plurality of roller cutters mounted rotatably on the inclined pins, respectively. Each of the inclined pins is formed to have a cylindrical side face and has its diameter gradually decreased continuously from the end portion to the root thereof. Each of the plain bearing members, which is divided into a plurality of parts in the axial direction and which is mounted around corresponding inclined pin, has an inner face which engages rotatably substantially all over the surface with the cylindrical outer face of the inclined pin and if necessary, all over the inner face of an opening of the roller cutter which is fitted on the outer circumference of the plain bearing members. The corresponding roller cutters and plain bearing members are made immovable relative to each other in the axial direction by the action of a holding mechanism.

10 Claims, 7 Drawing Figures

BORING DRILL BIT

BACKGROUND OF THE INVENTION

1. Field of the Invention

The present invention relates to the bit of a boring apparatus used for drilling oil wells, a geothermal wells or the like and, more particularly, to a drill bit which is fixed to the leading end of a drill pipe and which includes roller cutters attached to inclined pins, the drill bit boring a hole into the ground as the drill pipe is turned.

2. Description of the Prior Art

FIGS. 6 and 7 show a prior art boring drill bit which has roller cuutters, the drill bit including a shank 1, which is threaded to be connected to a drill pipe, and two or three legs 2 which are integral with the shank 1. Each leg 2 is formed with an inclined pin 3 which is inclined into the ground with respect to the center line of the shank 1 and made to project radially. The inclined pin 3 is crowned with a roller cutter 4 which has an identical conical contour and is made rotatable close to an adjacent one. FIG. 7 is a sectional view showing one of the inclined pins 3 according to the prior art. The inclined pin 3 protrudes from the corresponding leg 2 and towards the ground is formed as a straight cylinder having an equal diameter and has its ground-side end face 5 extending normal to the axis thereof. The end face 5 is formed at its center with a pilot pin 6 which has a smaller diameter. The straightly cylindrical inclined pin 3 extending from the leg 2 is formed in its outer circumference near the end face 5 with a groove 8 for fitting a plurality of bearing balls 7 therein.

From the inclined pin 3 to the leg 2, there extends a small hole 9 for feeding a lubricant to the bearing portion. The inclined pin 3 is formed with a hole 10 which is opened in the outer face of the leg 2 for guiding the balls 7 into the groove 8. The hole 10 is made to communicate with the small hole 9 so that it provides a lubricant passage. The hole 10 thus made is plugged at 11, while leaving its lubricant passage portion, so that it may prevent the balls 7 from coming out, and is welded at 12 to the leg 2.

The roller cutter 4 has its opening fitted on the outer circumference of the inclined pin 3 through a plain bearing 13 and the balls 7. As a result, the roller cutter 4 is made rotatable around the inclined pin 3. In the surface of the roller cutter 4, there are buried a number of edges 14 which are made of a tungsten carbide alloy. A flexible seal ring 15 is fitted on the root of the inclined pin 3 extending from the leg 2 so that the lubricant fed to the groove 3 will not flow out through the plain bearing 13.

When passed into the ground with the turning drill pipe, the roller cutter 4 revolves around the inclined pin 3 so that the ground is bored by the revolution of the roller cutter 4 on its axis and around the drill pipe.

The balls 7 play the roll of plain bearings and function to prevent the roller cutter 4 from coming out from the inclined pin 3.

When the oil or geothermal well is to be bored, the bit is driven into the ground as the drill pipe is turned. When either the edges of the bit or the bearings of the roller cutters are worn, the drill pipe is pulled out from the bore for replacement of the leading end portion of the drill pipe by a new one, and the drill pipe having its lower end equipped with the new bit is inserted into the bore so that the boring operation may be restarted. If the depth of the bored well is increased, it frequently takes a long time, e.g., one day to replace the bit.

For saving the boring cost, it is important to minimize the frequency of the bit replacement, i.e., to prolong the lifetime of the bit. The shortening of the bit lifetime is almost always caused by the fact that the edges are worn so much that they cannot be used any more or that the roller cutter bearings are worn so much that they cannot stand further use. The factors for determining the lifetime of the bearings are dependent upon how large the total surface area of the bearings or the projection area of the bearings upon a plane normal to the center line of the drill pipe is. Therefore, the lifetime of the bearings can be prolonged by reducing the load upon a unit area or by reducing the relative frictional speed of the bearings.

SUMMARY OF THE INVENTION

An object of the present invention is to provide a novel bearing structure for elongating the lifetime of a bit as a whole by elongating the lifetime of the bearing members of the bit.

In order to achieve the above-specified object, according to the present invention, the load upon a unit area is reduced by increasing the surface or projection area of the bearings of the bit. The drill bit according to the present invention comprises inclined pins, each inclined pin extending from a corresponding leg and having such a cylindrical outer face as to have its diameter reduced gradually in an undulating configulation from the end portion thereof to the leg; and plain bearing members, each plain bearing member being divided into a plurality of parts and having an inner wall engaging all over its face with the cylindrical outer wall of the corresponding one of the inclined pins rotatably around the corresponding inclined pin so that the plain bearing members may be fitted and fixed, the opening of a corresponding roller cutter on the outer circumference of the plain bearing member, or act as so-called "floating bearings" by making the roller cutter engage with the outer circumference of the plain bearing member rotatably relative to the plain bearing member.

With the construction described above, according to the present invention, even the portion where a bearing capacity is reduced because the bearing of the prior art has the ball bearing members is borne plainly to augment the bearing capacity and to dispense with the construction which is used to prevent the roller cutter from coming out from the corresponding inclined pin by means of the ball bearing members. Since the inclined pin has its diameter changing continuously to have a smaller-diameter portion at its intermediate portion, it is possible to increase the bearing area and to prevent the roller cutter from coming out. In case the floating bearing is used together, moreover, it is possible to reduce the relative frictional speed of the bearing.

BRIEF DESCRIPTION OF THE DRAWINGS

Other objects, features and advantages of the present invention will become apparent from the following description taken in connection with the embodiments of the invention with reference to the accompanying drawings, in which.

DESCRIPTION OF THE PREFERRED EMBODIMENTS

Figure 1:
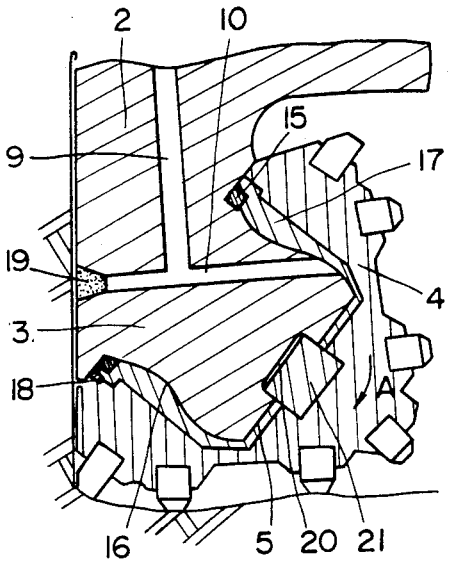
FIG. 1 is a sectional view showing a portion of the boring drill bit according to one embodiment of the present invention.

FIG. 1 is a sectional view showing both a portion of one leg and a portion of the corresponding one of inclined pins of the boring drill bit of the present invention.

Each of inclined pins 3, which are extended radially from the center of the drill bit at an inclination toward the ground from the shank 1 to the corresponding leg 2 of the drill bit, is formed with an end face 5 which is made of a plane normal to the center line thereof; and a cylindrical side face 16 which is so undulating as to have its diameter gradually increased, decreased and then increased from the end face 5, as viewed in the axial direction. The inclined pin 3 is enclosed by a plain bearing member 17 which is sized and shaped to contact with the inclined pin 3 at both the substantially whole surface of the cylindrical side face 16 and the end face of the inclined pin 3 so that it can rotate on its contact surface. The plain bearing member 17 is usually divided into two or three parts in the axial direction of the inclined pin 3.

A roller cutter 4 is formed with an opening, which has its inner wall contacting with the outer side of the plain bearing member 17 and which is fitted and fixed on the plain bearing member 17 after the plural parts of the plain bearing member 17 are assembed on the outer circumference of the inclined pin 3. The fixing means may resort to shrinkage fitting or friction welding but is not be limited to these two. The boundary between the inner edge of the opening of the roller cutter 4 and the outer edge of the plain bearing member 17 may be fastened by means of key 18. From the shank 1 to each of the inclined pin 3, there are extended a small hole 9 and a hole 10 for feeding a lubricant into the clearance between the side face 16 of the inclined pin 3 and the inner face of the plain bearing member 17 such that the open end of the hole 10 into the leg 2 is closed by a weld 19.

The inclined pin 3 is preferred in strength to have the maximum diameter of one of the maximum diameters at its root because it acts as a centilever.

The outer side of the plain bearing member 17 and the inner wall of the opening of the roller cutter 4 need not contact all over the areas because it is sufficient to establish a frictional force necessary for fixing the two.

The inclined pin 3 is formed at the center of its end face 5 with a recess 20, in which is fitted rotatably through the plain bearing member 17 a pilot pin 21 having its portion press-fitted in the center of the bottom of the opening of the roller cutter 4. This construction is helpful for providing a seat for the mounting stability of the roller cutter 4 and for receiving the axial force of the inclined pin 3. Moreover, the pilot pin 21 at the end portion of the inclined pin 3 also performs to act against the turning moment which is establish as a result of the wear of the pin to turn the roller cutter 4 in the direction of arrow A of FIG. 1.

Figure 2:
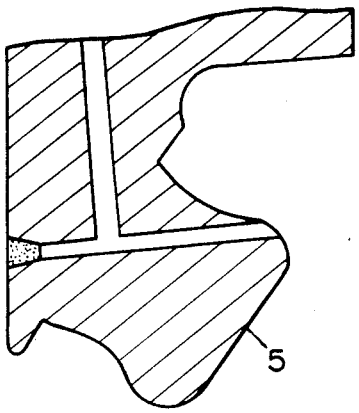
FIGS. 2 and 3 are sectional views showing modifications of the inclined pins of the boring drill bit of the present invention, respectively.
Figure 3:
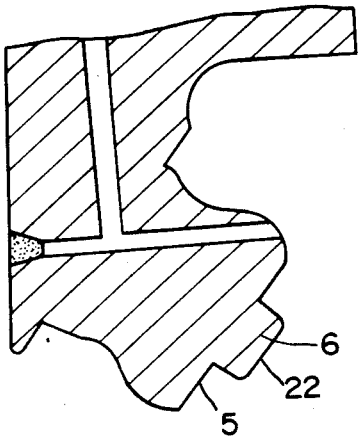
Figure 4:
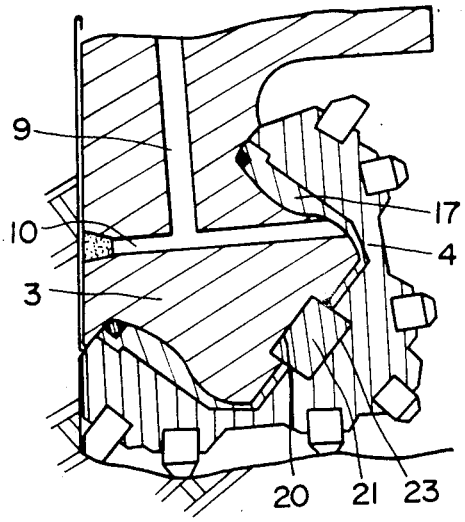
FIG. 4 is similar to FIG. 1 but shows another embodiment of the present invention.

The shapes of the end face 5 of the inclined pin 3 can be modified in various ways, the simplest one of which is exemplified by a flat end face 5 normal to the axial direction, as shown in FIG. 2. In another modification, as shown in FIG. 3, the end face 5 is formed at its center like the prior art with a pilot pin 6 which is made so short as to be fitted only in the plain bearing member 17 such that the ground-side end face of the plain bearing member 17 is flattened. As shown in FIG. 4, on the other hand, the pilot pin 21 extends through the plain bearing member 17 into the roller cutter 4 so that the end face 22 of the pilot pin 21 and the recess 23 formed in the bottom of the opening of the roller cutter 4 are made rotatable relative to each other. In order to project the pilot pin 21 from the inclined pin 3, as shown in FIG. 4, this pin 3 can be formed with the recess 20, in which the pilot pin 21 can be fitted and fixed. As shown in FIG. 1, moreover, the pilot pin projecting from the bottom of the opening of the roller cutter 4 may be made integral with the roller cutter 4 or may be fitted and fixed in the recess which is formed in the bottom of the roller cutter 4.

Figure 5:
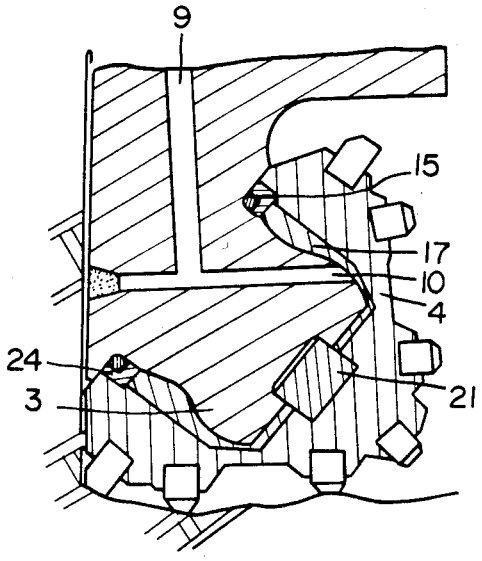
FIG. 5 is similar to FIGS. 1 and 4 but shows still another embodiment of the present invention.
Figure 6:
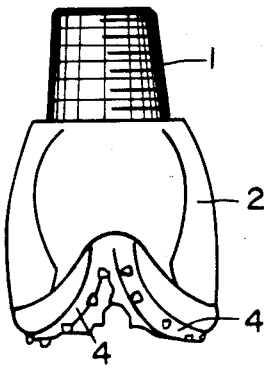
FIG. 6 PRIOR ART
FIG. 6 is a schematic side elevation showing the drill bit according to the prior art.
Figure 7:
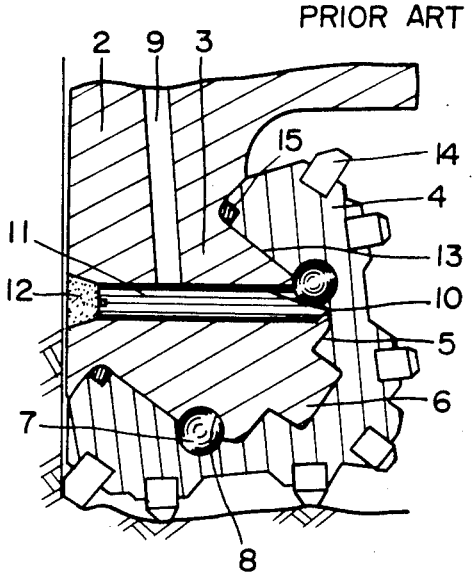
FIG. 7 PRIOR ART
FIG. 7 is a sectional view showing a portion of the boring drill bit according to the prior art.

FIG. 5 shows another embodiment of the present invention. The construction of the inclined pin 3 and the plain bearing member 17 is similar to that shown in FIG. 1, but the outer face of the plain bearing member 17 and the inner face of the opening of the roller cutter 4 are not fixed but engaged rotatably relative to each other. In the inner edge of the opening of the roller cutter 4, there is fitted a ring 24 which has its outer circumference fixed on the inner edge of the roller cutter 4 by means of the shrinkage fitting so that the roller cutter 4 may not come out from the plain bearing member 17 and which has its inner circumference made slidable relative to the root of the inclined pin 3. The lubrications of the outer face of the plain bearing member 17 and the inner face of the roller cutter 4 are effected by feeding the lubricant from the small hole 9 and the hole 10 to a groove or the like which is formed in the plain bearing member 17.

The construction of the end face 5 of the inclined pin 3, which is normal to the axial direction, may be in the same mode as that of the aforementioned case in which the outer face of the plain bearing member 17 and the inner face of the opening of the roller cutter 4 are fixed.

In the embodiment shown in FIG. 5, the inner and outer faces of the plain bearing member 17 are engaged rotatably so that it forms the so-called "floating plain bearing". As a result, the relative frictional speed of the bearing faces can be reduced to elongate the bearing lifetime to a remarkable extent.

As has been described in detail hereinbefore in connection with the embodiments, according to the present invention, the bearing lifetime can be elongated remarkably by increasing the bearing area, and this effect can be better promoted because the relative frictional speed of the bearing can be decelerated in case the floating plain bearing is adopted.

What is claimed is:

1. In a boring drill bit which comprises a shank which has a first end that can be attached to a drill pipe and second end, said shank defined an axial line therethrough; a plurality of elongated pin connected to the second end of said shank and around its circumference, said elongated pins extending radially outwardly with respect to said axial line and away from said first end of said shank so as to be inclined with respect to said axial line, each elongated pin having a root end connected to said shank and a free end and each elongated pin having a side surface and an end surface; and a plurality of roller cutters, each roller cutter having a generally cylindrical bore therein to enable it to be rotatably positioned over a respective elongated pin;

the improvement wherein the side surface of each of said elongated pins has an undulating shape such that successive cross sections through said elongated pin between said free end and said root end will be circular and will have gradually decreasing and then gradually increasing diameters; wherein a generally cup-shaped plain bearing is positioned between each elongated pin and each associated roller cutter, each generally cup-shaped plain bearing member having a side wall composed of a plurality of separate portions and a bottom portion which covers the end surface of said elongated pin, said side wall having an inner surface which is shaped to correspond with the undulating shape of the side surface of said elongated pin; and including holding means for connecting said generally cup-shaped plain bearing member to the associated roller cutter therearound so as to prevent axial movement therebetween.

2. A boring drill as defined in claim 1, wherein the side wall of said generally cup-shaped plain bearing member has an outer surface, and wherein said holding means comprises means for fitting and fixing the outer surface of the side wall of said generally cup-shaped plain bearing member to the generally cylindrical bore in said roller cutter.

3. A boring drill bit according to claim 2, wherein said fixing means has shrinkage fitting or frictional solvent welding means.

4. A boring drill bit according to claim 1, wherein each said roller cutter is rotatably connected to an outer surface of said generally cup-shaped plain bearing member, and wherein said holding means includes a ring fixed on the inner edge of the generally cylindrical bore in the associated roller cutter.

5. A boring drill bit according to claim 4, wherein said ring is shrink fitted on the inner edge of the generally cylindrical bore in the associated roller cutter.

6. A boring drill bit according to claim 1, further comprising a small hole in said shank for feeding a lubricant to said inclined pins and to said generally cup-shaped plain bearing member.

7. A boring drill bit according to claim 1, further comprises a pilot pin sandwiched between the end surface of each said elongated pin and the bottom of the generally cylindrical bore in each said roller cutter.

8. A boring drill bit according to claim 7, wherein the end surface of each elongated pin has a recess therein, wherein the bottom of the generally cylindrical bore in each roller cutter has a recess therein, wherein the bottom portion of said generally cup-shaped plain bearing member has a hole therethrough, and wherein said pilot pin extends through said hole in the bottom portion of said generally cup-shaped plain bearing member and is retained in the recesses in said end surface of said elongated pin and in the bottom of said generally cylindrical bore in said roller cutter, such that it is fixed in one of said recesses but is allowed to rotate relative to the other.

9. A boring drill bit according to claim 8, wherein said pilot pin extends through the hole in the bottom portion of said generally cup-shaped plain bearing member and is made integral with either said end surface of said elongated pin or the bottom of said generally cylindrical bore in said roller cutter and is rotatably fitted in the other recess.

10. A boring drill bit according to claim 1, wherein each generally cup-shaped plain bearing member is divided into two or three separate parts.

* * * * *

UNITED STATES PATENT AND TRADEMARK OFFICE

CERTIFICATE OF CORRECTION

PATENT NO. : 4,625,816

DATED : December 2, 1986

INVENTOR(S) : Sho Takano

It is certified that error appears in the above-identified patent and that said Letters Patent is hereby corrected as shown below:

On the title page insert:

-- [30] Foreign Application Priority Data

May 10, 1984 [JP] Japan ..... 93637/59 --.

Signed and Sealed this

Thirty-first Day of March, 1987

*Attest:*

DONALD J. QUIGG

*Attesting Officer*

*Commissioner of Patents and Trademarks*